United States Patent [19]

Decroix et al.

[11] Patent Number: 5,058,747

[45] Date of Patent: Oct. 22, 1991

[54] TRANSPORT/STORAGE CONTAINER WITH WOODEN PALLET FEET

[75] Inventors: Claude Decroix, Saverne; Andre Hamm, Drulingen, both of France

[73] Assignee: Sotralentz S.A., Drulingen, France

[21] Appl. No.: 641,749

[22] Filed: Jan. 16, 1991

[30] Foreign Application Priority Data

Jan. 17, 1990 [DE] Fed. Rep. of Germany .... 9000453[U]

[51] Int. Cl.[5] ..... B65D 19/00; B65D 90/20

[52] U.S. Cl. ..... 206/599; 206/386; 220/668; 220/9.1

[58] Field of Search ..... 206/599, 386; 220/668, 220/9.1

[56] References Cited

U.S. PATENT DOCUMENTS

| | | | |
|---|---|---|---|
| 1,148,948 | 8/1915 | Benjamin | 220/9.1 X |
| 1,148,949 | 8/1915 | Benjamin | 220/9.1 |
| 2,898,122 | 8/1959 | Beckner | 206/599 X |
| 4,947,988 | 8/1990 | Schutz | 220/668 |

*Primary Examiner*—William I. Price

*Attorney, Agent, or Firm*—Herbert Dubno; Andrew Wilford

[57] ABSTRACT

A transport and storage container for flowable materials has an annular and erect outer wall in the form of a gridwork of bars having a lower edge and provided at the edge with an annular stiffening bar and a pallet-like floor downwardly closing the wall, forming therewith an outer vessel, and provided with a plurality of wooden foot beams each having a ground-engaging lower surface, an upper surface, and a pair of ends. Respective steel plates on the upper surfaces of the foot beams each have bent-down ends overlying the respective beam ends. Fasteners such as screws or nails are engaged through the steel-plate ends into the respective beam ends. Integral connections are provided between each of the plates and the annular stiffening bar at the lower edge of the wall. An inner vessel composed of flexible plastic material is enclosed by the outer wall and supported on the floor.

8 Claims, 2 Drawing Sheets

TRANSPORT/STORAGE CONTAINER WITH WOODEN PALLET FEET

FIELD OF THE INVENTION

The present invention relates to a transport and storage container. More particularly this invention concerns such a container provided with pallet feet so it can be handled by a fork-lift truck.

BACKGROUND OF THE INVENTION

A storage and/or transport container for fluent material is known which comprises an erect and annular side wall and a flat and horizontal bottom wall joined together at the outer edge of the bottom wall and lower edge of the side wall to form an upwardly open vessel, and a flexible bag or bladder within this vessel that lies against its inner surface and that itself contains the material being transported or stored. The side and bottom walls are typically made of round-section metal bars or rods that are spot-welded together in a criss-crossed gridwork with the bars welded at the intersections. It is also possible to use profiled bars and is in fact standard to provide a profiled rim element around the upper edge of the side wall. Frequently extra bars are integrated into the bottom or side wall for increased localized stiffness.

It is standard also to bend the rods forming the bottom wall to form pallet-like feet or to weld specially bent rods to the floor to form such feet. This makes it particularly easy to handle these containers, which often contain a cubic meter, by means of a fork-lift truck or by means of a crane. It has even been suggested to add wooden blocks to the bottom wall to make such pallet feet. Such blocks are stapled to the rods or plates welded to the rods are screwed to the blocks.

Such arrangements typically fail at the connection between the gridwork vessel and the pallet feet. The inherently rough treatment of moving the container around creates considerable stress where these feet join the vessel. In addition vibration during rail or truck transport is particularly effective to damage the connection between each pallet foot and the gridwork vessel, so that the containers usually fail first at this location, in particular at the connection between the middle foot and the side wall.

OBJECTS OF THE INVENTION

It is therefore an object of the present invention to provide an improved storage/transport container.

Another object is the provision of such an improved storage/transport container which overcomes the above-given disadvantages, that is whose pallet feet are unlikely to become disconnected with normal use.

SUMMARY OF THE INVENTION

A transport and storage container for flowable materials according to the invention has an annular and erect outer wall in the form of a gridwork of bars having a lower edge and provided at the edge with an annular stiffening bar and a palletlike floor downwardly closing the wall, forming therewith an outer vessel, and provided with a plurality of wooden foot beams each having a ground-engaging lower surface, an upper surface, and a pair of ends. Respective steel plates on the upper surfaces of the foot beams each have bent-down ends overlying the respective beam ends. Fasteners such as screws or nails are engaged through the steel-plate ends into the respective beam ends. Integral connections are provided between each of the plates and the annular stiffening bar at the lower edge of the wall. An inner vessel composed of flexible plastic material is enclosed by the outer wall and supported on the floor.

Thus with the system of this invention the annular stiffening bar at the lower edge of the side wall is very solidly connected to the steel plate which itself is very solidly mounted on the foot beams. Thus there is virtually no possibility of disconnection at this critical location.

According to the invention the connections are welds. This provides an extremely solid joint between the plate and the stiffening bar. The plate in turn is secured at the ends to the beams so that there is virtually no possibility of disconnection of the plate from the beam.

In addition according to the invention each of the foot beams extends horizontally the full width of the container and is connected at two opposite side locations to the stiffening bar. The foot beams include two parallel outer foot beams adjacent respective sides of the container and a middle foot beam flanked by the outer foot beams and generally central in the container. The integral connection with the middle beam includes straps extending over the stiffening bar and the connections are welds securing the straps to the plate of the middle bar. The integral connections between the outer beams and the stiffening bar are fillet welds.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
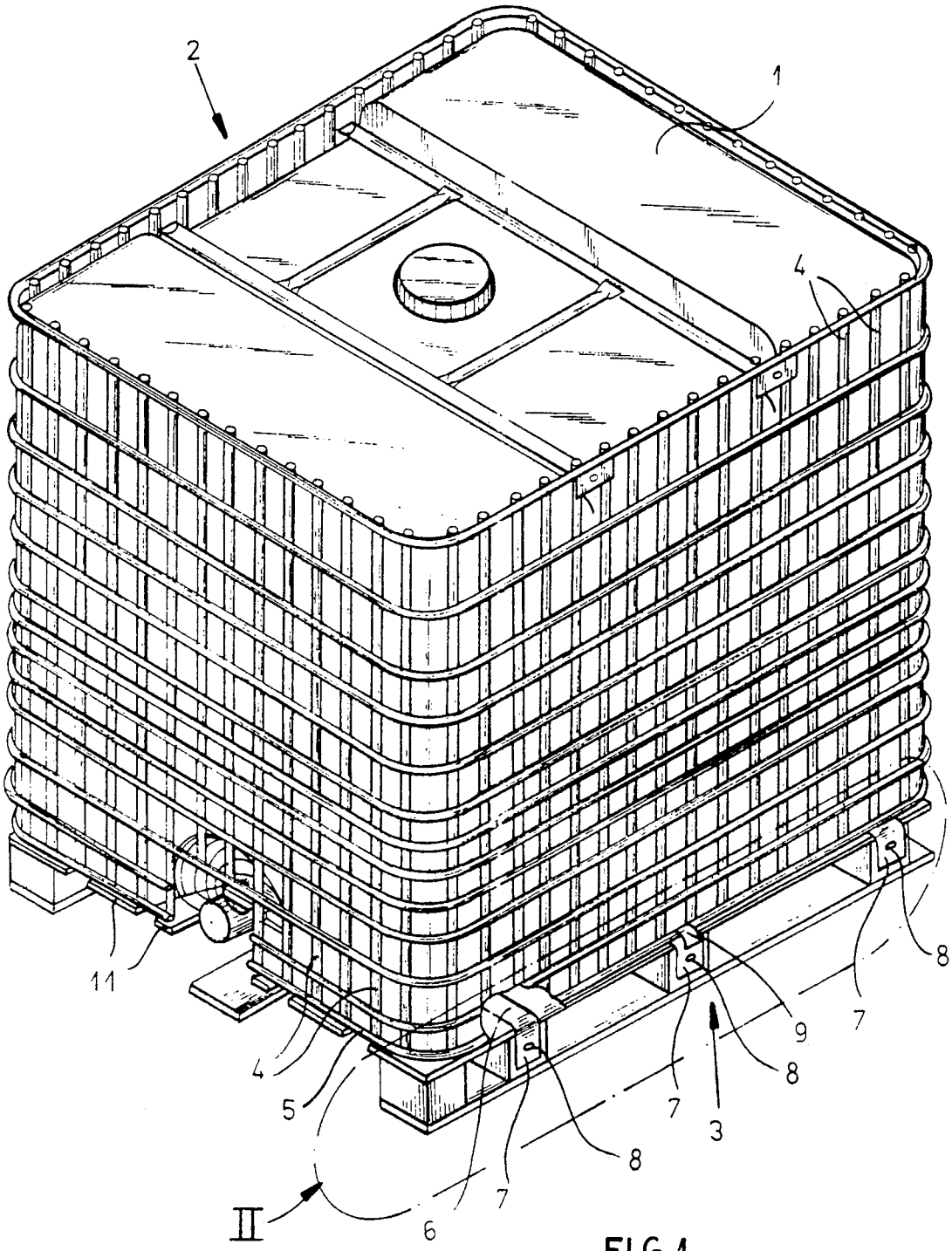
FIG. 1 is a perspective view of the container according to the invention.

As seen in FIG. 1 a flexible bladder 1 is held in a vessel formed by an annular wall 2 and a wooden pallet-like floor 3. The wall 2 is made of a gridwork of horizontal and vertical bars or rods 4 welded together where they cross one another and an annular round-section bar 4 forming the lower edge of the wall 2 and welded to the lower ends of the vertical bars 4.

The floor 3 is formed by a plurality of wooden slats 11 and three parallel and square-section wooden beams 12 that each extend the full length across the bottom of the wall 2, two of the beams 12 running along sides of the container and one in the middle.

Figure 2:
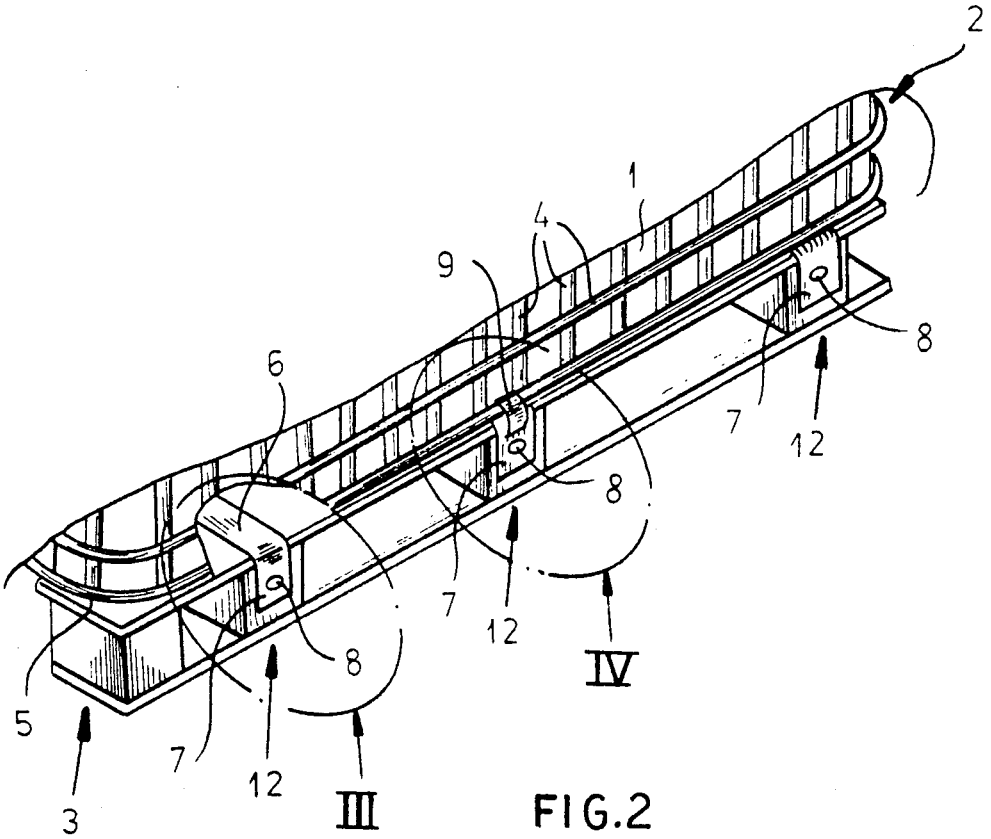
FIG. 2 is a large-scale view of the detail indicated at II in FIG. 1.
Figure 4:
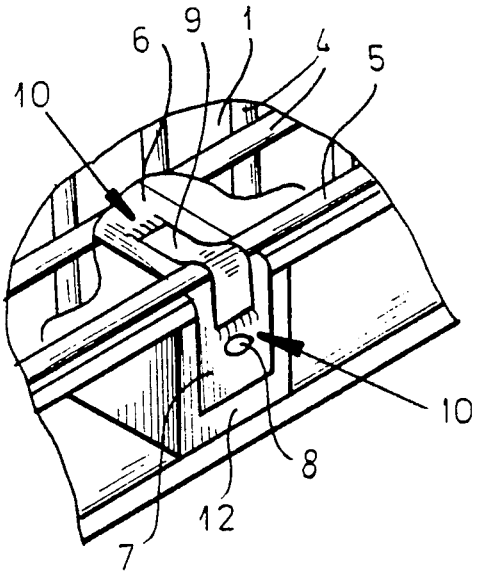
FIGS. 3 and 4 are larger-scale views of the details indicated at III and IV, respectively, in FIG. 2.
Figure 3:
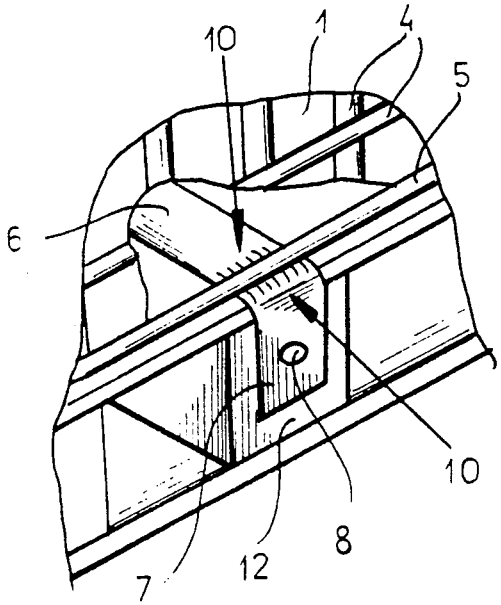

According to this invention as better seen in FIGS. 2 through 4 each beam 12 is provided on its upper surface with a steel plate 6 that runs the full length of the respective beam 12 and that has bent-down ends 7 secured by nails or screws 8 to the ends of the respective beam 12. The stiffening bar 5 lies directly on these plates 6 and is secured directly by fillet welds 10 (FIG. 3) to the plates 6 of the two outer beams 12. A steel strap 9 (FIG. 4 ) overlies the bar 5 of the middle beam 12 and is secured to the respective plate 6 by fillet welds 10, one on the top portion of the respective plate 6 and the other on the bent-over end portion 7.

With the system of this invention there is virtually no likelihood of disconnection of the side wall 2 from the floor 3. In particular vibration, which is most effective at the center of the container, will be no problem because the straps 9 will permit limited movement of the bar 5 relative to the plate 6, thereby avoiding metal fatigue. On the outer beams 12 there is less vibration effect so direct welding will be strong enough to hold the parts together.

We claim:

1. A transport and storage container for flowable materials comprising:

an annular and erect outer wall in the form of a gridwork of bars having a lower edge and provided at the edge with an annular stiffening bar;

a pallet-like floor downwardly closing the wall, forming therewith an outer vessel, and provided with a plurality of wooden foot beams each having a ground-engaging lower surface, an upper surface, and a pair of ends;

respective steel plates on the upper surfaces of the foot beams and each having bent-down ends overlying the respective beam ends;

fasteners engaged through the steel-plate ends into the respective beam ends;

integral connections between each of the plates and the annular stiffening bar at the lower edge of the wall; and an inner vessel composed of flexible plastic material enclosed by the outer wall and supported on the floor.

2. The transport and storage container defined in claim 1 wherein the connections are welds.

3. The transport and storage container defined in claim 1 wherein the fasteners are nails or screws.

4. The transport and storage container defined in claim 1 wherein each of the foot beams extends horizontally the full width of the container and is connected at two opposite locations to the stiffening bar.

5. The transport and storage container defined in claim 4 wherein the foot beams include two parallel outer foot beams adjacent respective sides of the container and a middle foot beam flanked by the outer foot beams and generally central in the container.

6. The transport and storage container defined in claim 5 wherein the integral connection with the middle beam includes straps extending over the stiffening bar and the connections are welds securing the straps to the plate of the middle bar.

7. The transport and storage container defined in claim 6 wherein the integral connections between the outer beams and the stiffening bar are fillet welds.

8. The transport and storage container defined in claim 1, wherein the floor includes wooden slats overlying the beams and underlying the plates.

* * * * *